US005832619A

United States Patent [19]

Volkema, Jr.

[11] Patent Number: 5,832,619

[45] Date of Patent: Nov. 10, 1998

[54] ADJUSTABLE TILE INSTALLATION TOOL AND METHOD OF USE

[76] Inventor: Charles L. Volkema, Jr., 2201 Washington Dr., Sanford, Fla. 32771

[21] Appl. No.: 726,902

[22] Filed: Oct. 7, 1996

[51] Int. Cl.[6] ..... G01B 3/00

[52] U.S. Cl. ..... 33/527; 33/DIG. 20

[58] Field of Search ..... 33/526, 527, DIG. 20; 52/747.11, 749.11, 127.2, 127.3, 387, 389, 392

[56] References Cited

U.S. PATENT DOCUMENTS

| | | | |
|---|---|---|---|
| 999,770 | 8/1911 | Fogertey | 33/527 |
| 2,852,932 | 9/1958 | Cable | 33/526 |
| 3,199,205 | 8/1965 | Halde et al. | 33/526 |
| 3,775,856 | 12/1973 | Schmidt | 33/526 |
| 4,135,338 | 1/1979 | Malavasi | 52/389 |
| 4,712,309 | 12/1987 | Kingston et al. | 33/527 |
| 4,827,625 | 5/1989 | Le Moal | 33/527 |
| 5,459,938 | 10/1995 | Knight et al. | 33/526 |

FOREIGN PATENT DOCUMENTS

| | | | |
|---|---|---|---|
| 723350 | 12/1965 | Canada | 52/747.11 |

*Primary Examiner*—Thomas B. Will
*Attorney, Agent, or Firm*—John C. Smith

[57] ABSTRACT

An adjustable frame for simultaneously aligning and installing multiple tiles. The adjustable frame contains a plurality of tile apertures. Each tile aperture is sized to accept a particular tile size. Tiles are inserted into each of the tile apertures to allow multiple tiles to be installed and automatically be aligned with one another during the installation process. The width of the grout area between the tiles is thus automatically set by the width of the adjustable frame segments. The adjustable frame is fabricated from independent frame segments which have internal adjustment rod channels. Adjustment rods are adjustably secured to two frame segments such that the distance between the frame segments can be selectably varied. By varying the distance between frame segments, the size of the tile aperture is varied, and therefore the tile size can be varied. The size of the tile apertures can be independently varied in a lateral direction or in a longitudinal direction. Frame segments are independently adjustable such that multiple tile sizes can be installed simultaneously. Tiles with a square or rectangular shape can be installed simultaneously. An alternative embodiment includes an adjustment rod that has indicia for selecting the desired tile size.

19 Claims, 11 Drawing Sheets

ADJUSTABLE TILE INSTALLATION TOOL AND METHOD OF USE

BACKGROUND OF THE INVENTION

Technical Field

The present invention relates to tile installation. In particular, it relates to an adjustable tile installation tool which automatically aligns a plurality of tiles for simultaneous installation. The tool is size adjustable to allow a variety of tile sizes to be installed. In addition, multiple tile sizes can be simultaneously installed.

Background Art

A primary concern of tile installers is the alignment of an individual tile in relation to the other tiles. If an error in one tile is continued in adjacent tiles, the result will be magnified such that the installation will be unacceptable and the tiles will have to be replaced. As a result, a tile installer must be careful when installing tiles to avoid the problems created by mis-aligned tiles.

Another competing concern of tile installers is the speed at which tiles can be installed. Of course, the care taken by an installer results in improved quality of the finished work, but it also results in increased installation time and cost. However, taking extra time to avoid errors in installation will result in increased labor expense.

Installers use a variety of methods to maintain the quality of the tile installation while completing the installation process as fast as possible. The most basic methods use markings on the surface or a string to align the tiles. Marking the installation surface requires the mortar to be carefully applied such that the marks remain visible. The use of strings to define a line also has the disadvantages of the flexing of the string which may create error as well as a slight mis-alignment of the string which will also inject error. In addition to potential errors, the use of the foregoing techniques also increases the amount of time required for the installation which results in increased cost.

Another attempt to reduce installation error and reduce installation time has been through the use of spacers. Spacers designed to separate adjacent tiles by a desired grout width are commercially available and allow the installer to carefully install a first set of tiles and then use the spacers to install more tiles adjacent to them. A disadvantage of this technique is the cost of the spacers and the time required to set them in place.

One method of installing tiles has been the use of a frame designed to space tiles an appropriate distance. This type of frame is a fixed grid which is designed for a specific tile size. The disadvantage of this type of device is that it is a fixed size which requires a professional installer to carry multiple frames in order to be capable of installing any tile size.

A further disadvantage of this type of frame is that it is only capable of installing one type of tile at a time. In some installations, a variety of tile sizes are installed. For example, a pattern of tiles may include a central area having one tile size with a perimeter area having a different tile size. It would be desirable to have a single device which can be used to accurately and quickly install one or more tile sizes, either alone or as a mix of tile sizes.

While the prior art has addressed the basic desirability of installing tiles accurately and has attempted to minimize the time required to install tile, the prior art has failed to provide a device or method of use which allows tiles to be quickly and inexpensively installed with a minimum of error. Further, the prior art has failed to provide a single device which can be used to install multiple tile sizes, and further, the prior art has failed to provide a device and method of use which allows multiple tile sizes to be installed simultaneously and with uniform spacing for grout.

SUMMARY OF THE INVENTION

The present invention solves the foregoing problems by providing an adjustable frame which contains a plurality of tile apertures. Each tile aperture is sized to accept a particular tile size. Tiles are inserted into each of the tile apertures to allow multiple tiles to be installed and automatically be aligned with one another during the installation process. The frame structure which defines the tile apertures has a wall thickness set to the particular width for the grout being used between adjacent tiles. The width of the grout area between the tiles is thus automatically set by the width of the adjustable frame segments. The adjustable frame is fabricated from independent frame segments which have internal adjustment rod channels. Adjustment rods are inserted in the adjustment rod channels and adjustably secured to two frame segments such that the distance between the frame segments can be selectably varied. By varying the distance between frame segments, the size of a tile aperture, and therefore the tile size, can be varied. The size of the tile apertures can be independently varied in a lateral direction and/or in a longitudinal direction. Frame segments are independently adjustable such that multiple tile sizes can be installed simultaneously. Tiles with a square or rectangular shape can be installed simultaneously. An alternative embodiment includes an adjustment rod that has indicia for setting the desired tile size.

DESCRIPTION OF THE PREFERRED EMBODIMENT

Prior to a discussion of the figures, the following definitions will be used throughout the specification for ease of discussion. The term "tile" will be used to describe all forms of ceramic and clay tiles, as well as other flooring and wall materials such as marble, stone, etc. The term "adhesive" will be used to indicate adhesives, glue, mortar or any other material which can be used to secure a tile to a target surface.

Figure 1:
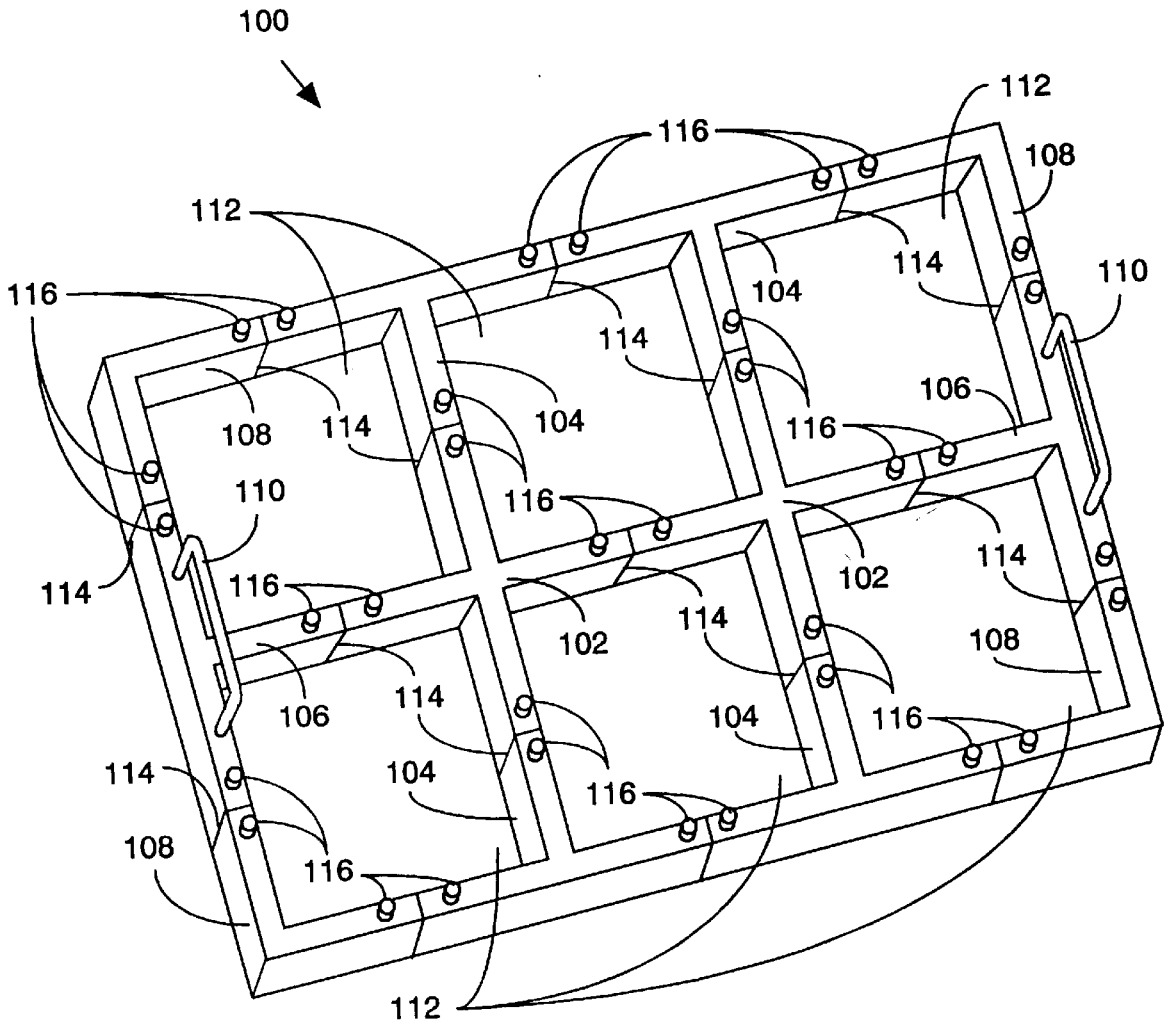
FIG. 1 is a perspective upper and side view of a preferred embodiment of the invention.

Referring to FIG. 1, this figure shows a preferred embodiment of an adjustable tile installation tool 100. The adjustable tile installation tool 100 defines a set of tile apertures 112, each tile aperture 112 is set to a preselected tile size (for example, four inches). The tile apertures 112 are defined by a frame which is formed by frame segments 102, 104, 106, 108. Each frame segment 102, 104, 106, 108 is secured to an adjacent segment by an adjustment rod 502 (shown in FIG. 5A). The frame segments 102, 104, 106, 108 are joined at their ends at seams 114 and form a wall which defines the size and shape of the tile aperture 112.

In the preferred embodiment, the adjustment rods 502 are inserted into an adjustment rod channel 504 (shown in FIG. 5A) in frame segments 102, 104, 106, 108. The adjustment rods 502 are secured in the adjustment rod channel 504 by retaining knobs 116 which are threaded through the walls of frame segments 102, 104, 106, 108. When threaded through the frame segments 102, 104, 106, 108, retaining knobs 116 press adjustment rods 502 firmly against the inside of frame segments 102, 104, 106, 108 and hold the frame segments 102, 104, 106, 108 together. Also shown in this figure are handles 110.

Tiles 1002 (shown in FIG. 10B) are installed as follows. The appropriate adhesive is applied to the target surface. The adjustable tile installation tool 100 is then set into position on the target surface. The tiles 1002 are set in place by inserting them into the tile apertures 112. Once the tiles 1002 are secured by the adhesive, the adjustable tile installation tool 100 is raised by lifting the handles 110. Then, the adjustable tile installation tool 100 is moved to an adjacent area and the process is repeated.

The width of frame segments 102, 104, 106, 108 are sized to provide the desired separation distance between tiles 1002 (i.e., the grout space). As a result, the tiles 1002 are automatically spaced to accommodate the appropriate amount of grout.

Also, in this figure the device is shown with the tile apertures 112 in the retracted (or smallest tile size) configuration.

While the preferred embodiment envisions the adjustable tile installation tool 100 being fabricated by a moldable material, such as plastic, polyethylene, polypropylene, etc., those skilled in the art will recognize that the device can be made of any suitable material such as metal, wood, etc.

Figure 2:
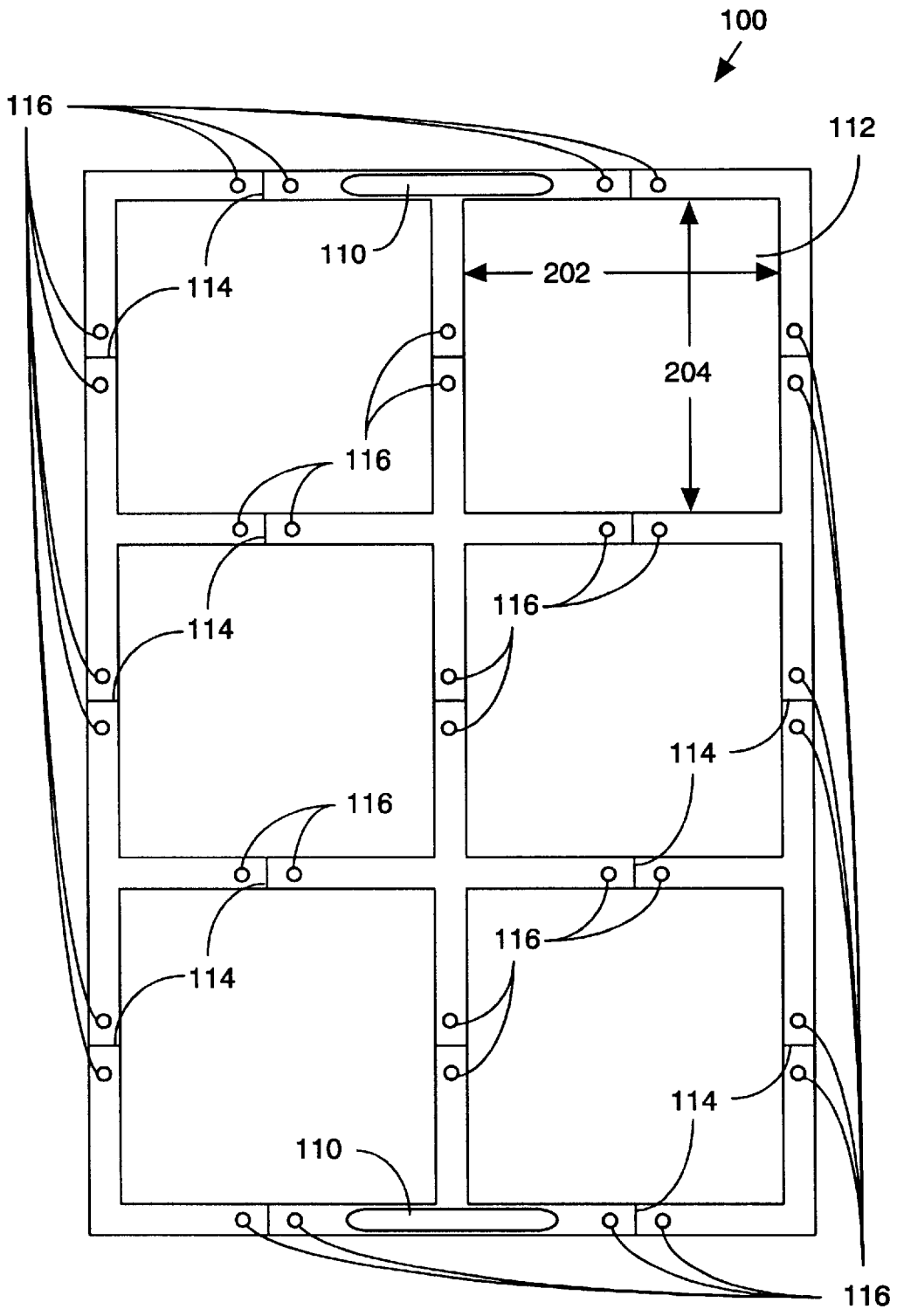
FIG. 2 is a top view of a preferred embodiment of the invention showing the tile apertures, frame segments, retaining knobs and handles.

In FIG. 2, a top plan view of adjustable tile installation tool 100 is shown. This figure also shows the device in the retracted position which is designed for the smallest size tile 1002. In this figure, the tile apertures 112 are shown as squares with equal lateral sizes 202 and longitudinal sizes 204. However, tiles 1002 come in a variety of rectangular sizes. Therefore, the retracted position does not have to use square tile apertures 112 as the default shape and any number of rectangular sizes can be substituted.

Also shown are handles 110 which are shaped such as not to interfere with insertion of tiles 1002 into tile apertures 112. In the preferred embodiment, handles 110 are convention handles 110. However, they can be any suitable shape and even be molded as part of the frame segments 106.

The locations of retaining knobs 116 are also shown. A retaining knob 116 is provided on each side of a seam 114 to secure each frame segment 102, 104, 106, 108 to its respective adjustment rod 502.

Figure 3:
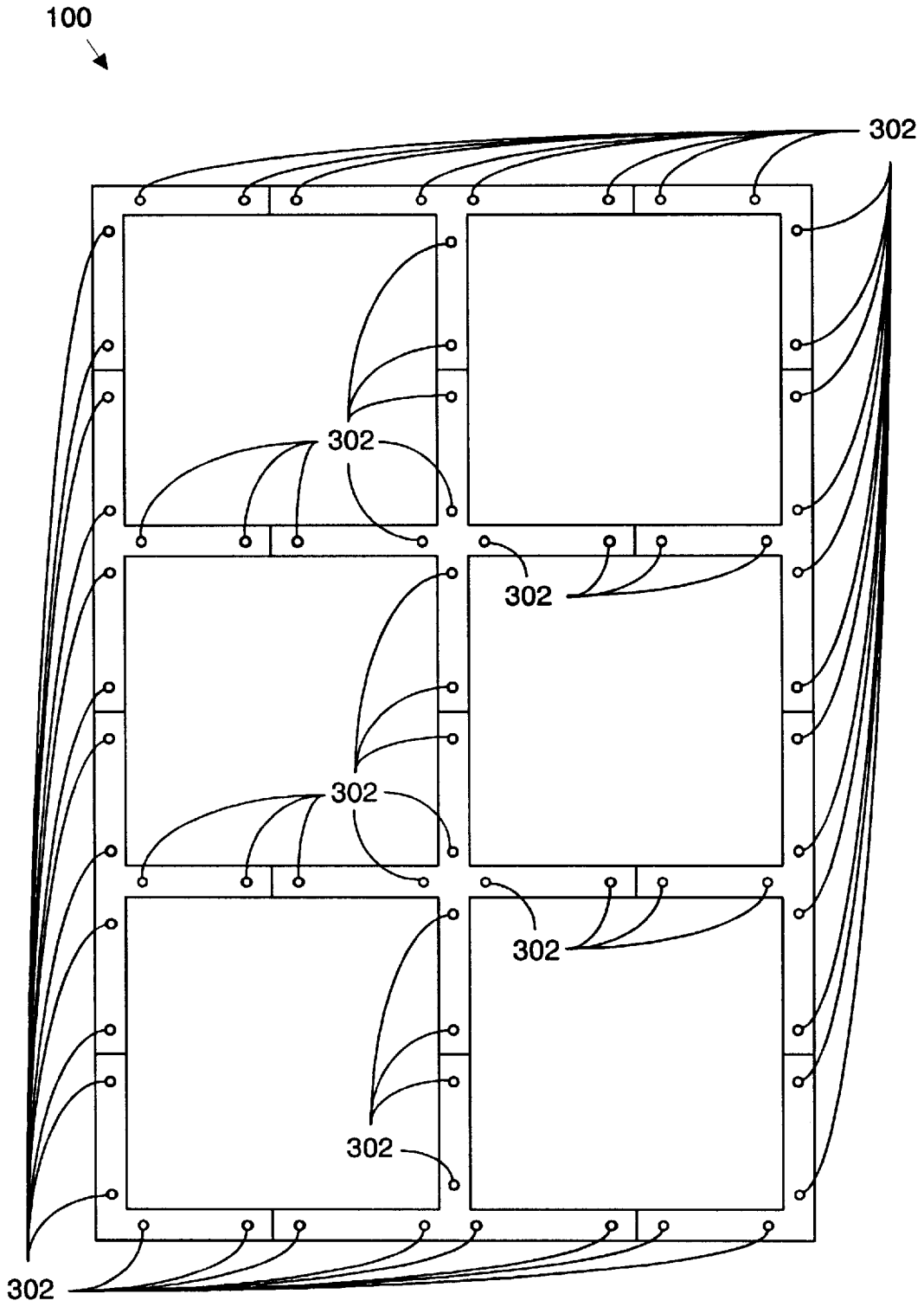
FIG. 3 is a bottom view of a preferred embodiment of the invention showing the tile apertures, frame segments and seating pins.

FIG. 3 shows a bottom view of the adjustable tile installation tool 100. A number of seating pins 302 are shown on the bottom surface of the device. The purpose of the seating pins 302 is to prevent the adjustable tile installation tool 100 from becoming stuck in the adhesive during tile 1002 installation by raising the bottom surface of the device off of the target surface.

Figure 4A:
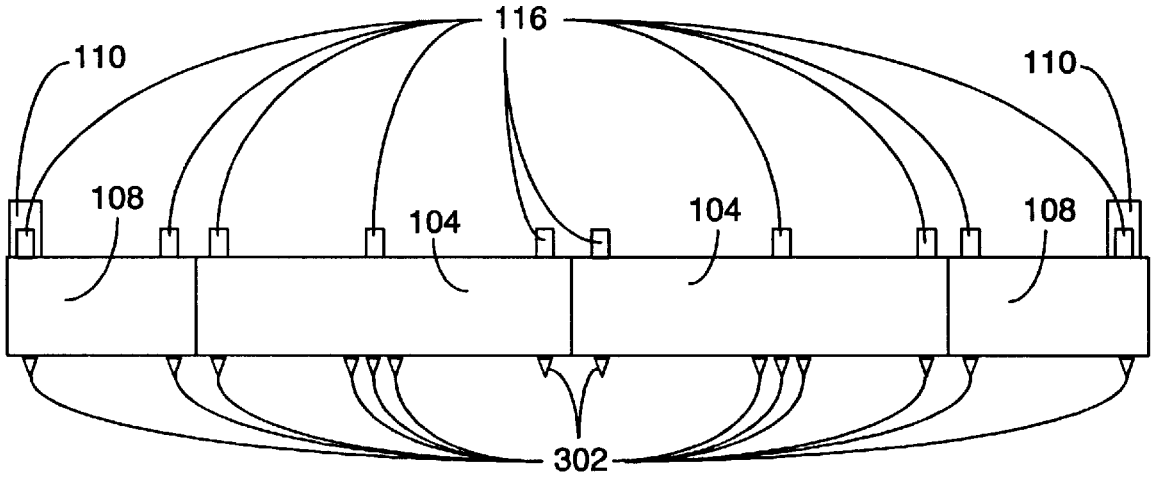
FIG. 4A is a side view of a preferred embodiment illustrating the frame segments, retaining knobs, seating pins and handles.

FIG. 4A shows a side view of the adjustable tile installation tool 100. This view shows the retaining knobs 116 and the seating pins 302. As can be seen, the seating pins 302 reduce the amount of contact with the target surface such that the adhesive is less apt to prevent the adjustable tile installation tool 100 from being removed.

Figure 4B:
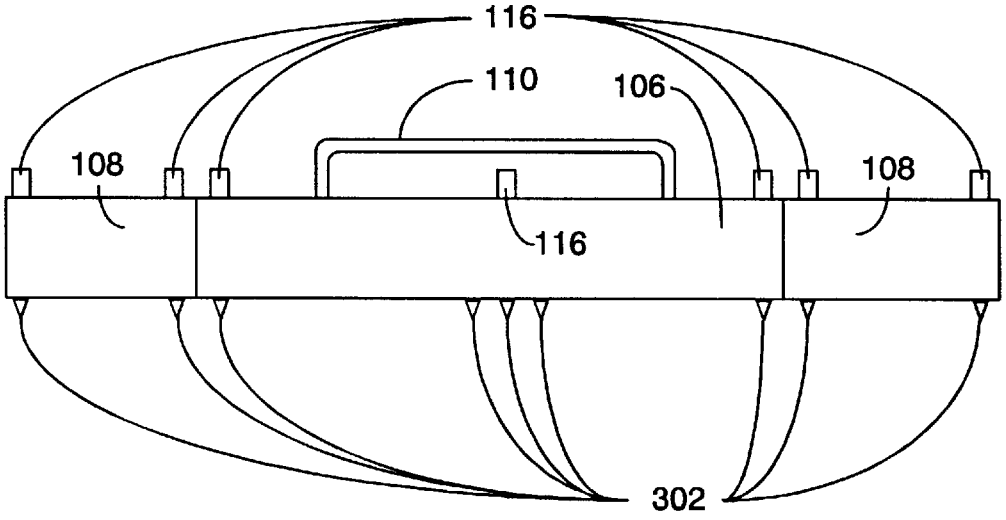
FIG. 4B is an end view of a preferred embodiment illustrating the frame segments, retaining knobs, seating pins and handles.

FIG. 4B shows an end view of the adjustable tile installation tool 100. This figure and the previous FIG. 4A illustrates the positioning of the retaining knobs adjacent the seams 114.

Figure 5A:
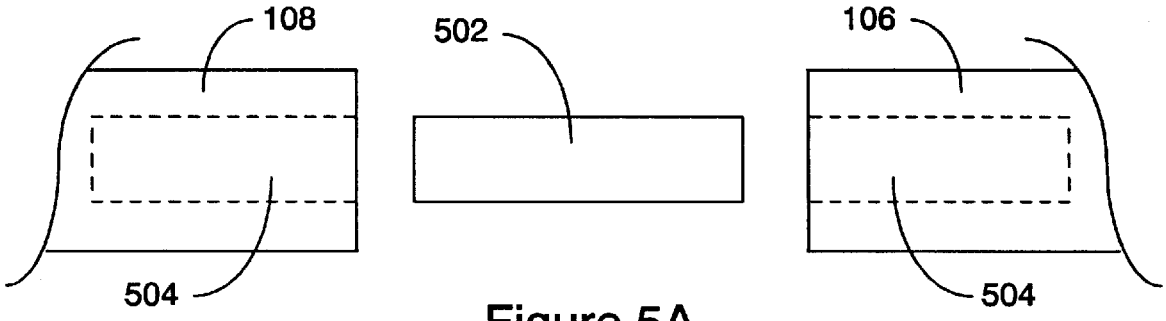
FIG. 5A is an exploded side transparent view of a corner frame segment and an end frame segment, each having an adjustment rod channel. Also shown is a adjustment rod.

FIG. 5A shows a transparent view of frame segments 106, 108. In this view, adjustment rod channels 504 are shown in each of the frame segments 106, 108. The adjustment rod channels are formed in the ends of the frame segments 102, 104, 106, 108 such that the ends of two adjacent frame segments 102, 104, 106, 108 can be joined to form a wall that defines a tile aperture 112. Also shown in this figure is adjustment rod 502. The adjustment rod channels 504 are sized to slidably accept the adjustment rod 504. The preferred embodiment uses a flat bar as the adjustment rod 502. However, those skilled in the art will recognize that any suitable shape can be used so long as the overall width of the frame segments 102, 104, 106, 108 is not too wide for the intended grout width.

Figure 5B:
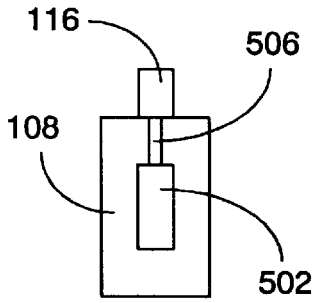
FIG. 5B is an end view of a frame segment with an adjustment rod inserted into the adjustment rod channel.

FIG. 5B shows an end view of a frame segment 108. This view illustrates the adjustment rod 502 inserted in the adjustment rod channel 504. Also shown is the retaining knob 116. Retaining knob 116 has an integral threaded screw shaft 506 which threads through the wall of frame segment 108 and secures adjustment rod 502 within adjustment rod channel 504 via a pressure fit. A knurled knob end is used to allow finger tightening of the retaining knob 116 without having to resort to special tools.

The preferred embodiment envisions a simple screw device as the retaining knob 116, but those skilled in the art will recognize that any suitable means to secure the frame segments 102, 104, 106, 108 to adjustment rods 502 can be used. For example, a lever and cam arrangement can be used, etc.

Figure 5C:
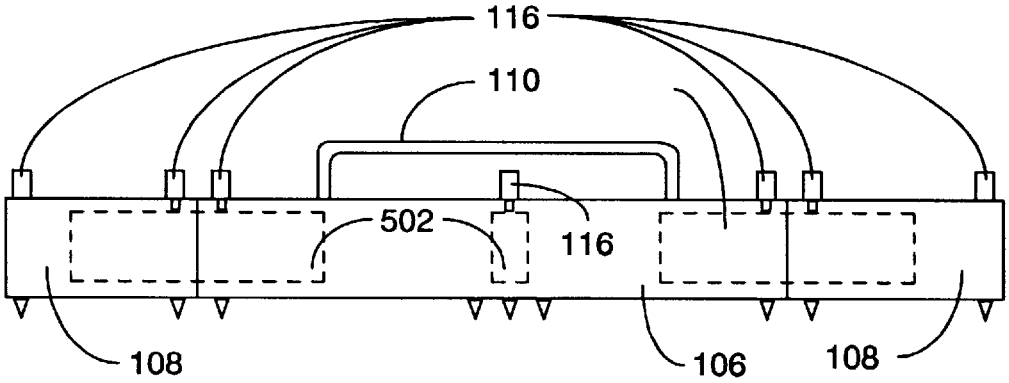
FIG. 5C is an end transparent view of a corner frame segment and an end frame segment, each having an adjustment rod channel. Adjustment rods are shown inserted into the adjustment rod channels. The retaining knobs are shown holding the adjustment rods in place.

FIG. 5C shows a transparent end view of the adjustable tile installation tool 100. In this figure, the adjustment rods 502 are shown secured within the adjustment rod channels 504 by retaining knobs 116. In this view, the adjustable tile installation tool 100 is in the retracted position.

Figure 6:
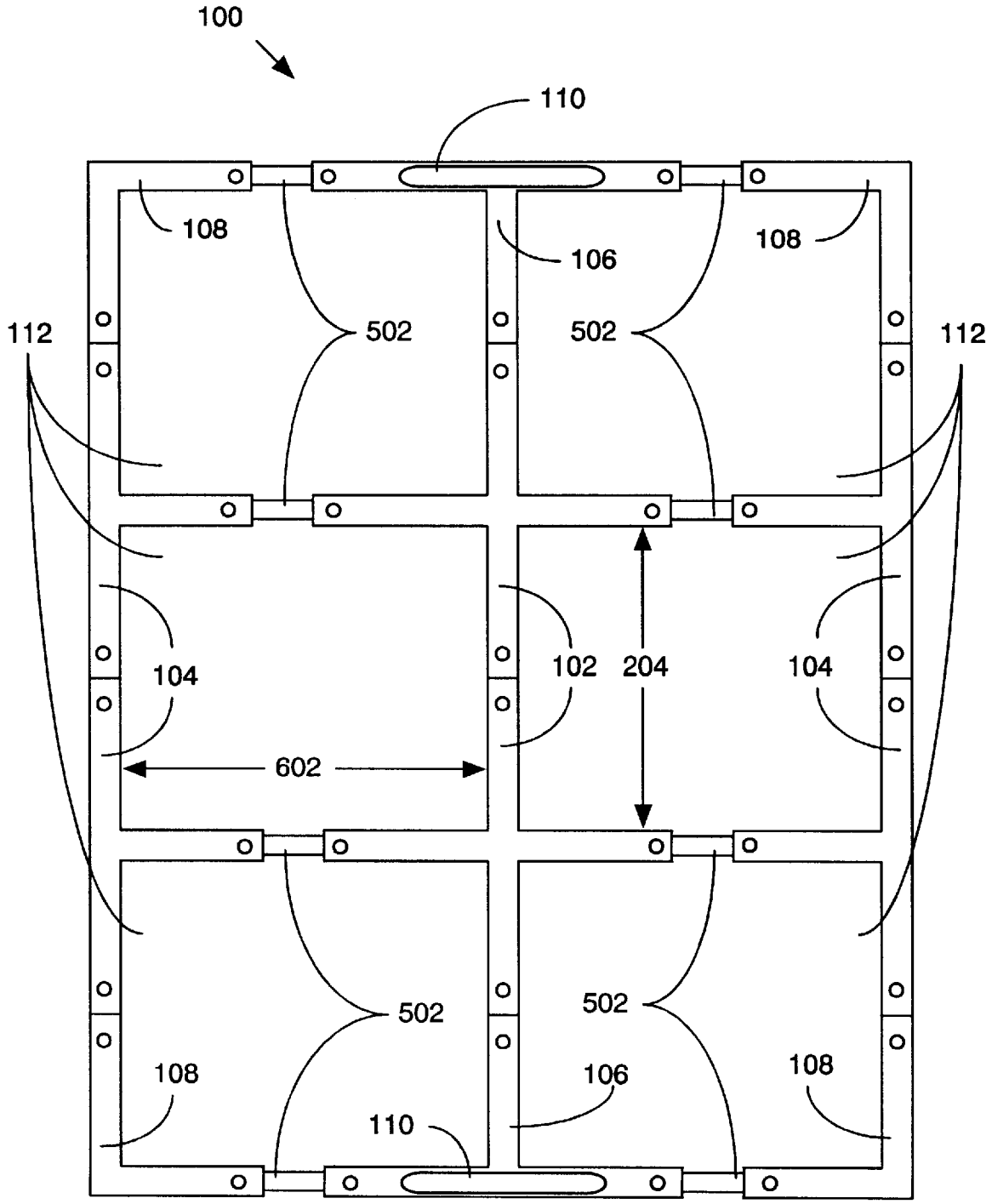
FIG. 6 illustrates a preferred embodiment of the tile alignment tool with the frame segments extended laterally.

FIG. 6 illustrates the adjustable tile installation tool 100 in a laterally extended position. In this position, the lateral size 602 of the tile apertures 112 has been increased by moving the frame segments 104, 108 to a laterally extended position. This is accomplished by loosing retaining knobs 116, sliding the frame segments 104, 108 away from frame segments 102, 106, respectively, and then retightening retaining knobs 116. The adjustment rods 502 allow the size of the tile apertures 112 to be varied by allowing the frame segments 102, 104, 106, 108 to be moved to an extended position. Since the retaining knobs 116 secure the adjustment rods 502 via pressure fit, the size of the tile aperture 112 can be continuously varied to suit any particular tile size. The only limitation being the size of the frame segments 102, 104, 106, 108 and the size of the adjustment rods 502.

For ease of illustration, both sides of the device are shown in the extended position. However, those skilled in the art will recognize that one side can be extended and the other retracted to allow the adjustable tile installation tool 100 to be used to install two tile sizes simultaneously. Also, the adjustable tile installation tool 100 is shown throughout the specification as having two rows of tile apertures 112 with three tile apertures 112 in each row. However, the number of tile apertures 112 can vary depending on the number of rows or the number of apertures per row in a particular adjustable tile installation tool 100. The only limitation being the ability of a tile installer to conveniently manipulate the adjustable tile installation tool 100. Also, in its simplest form, the tile installation tool 100 can be manufactured with a single tile aperture and only two frame segments.

Figure 7:
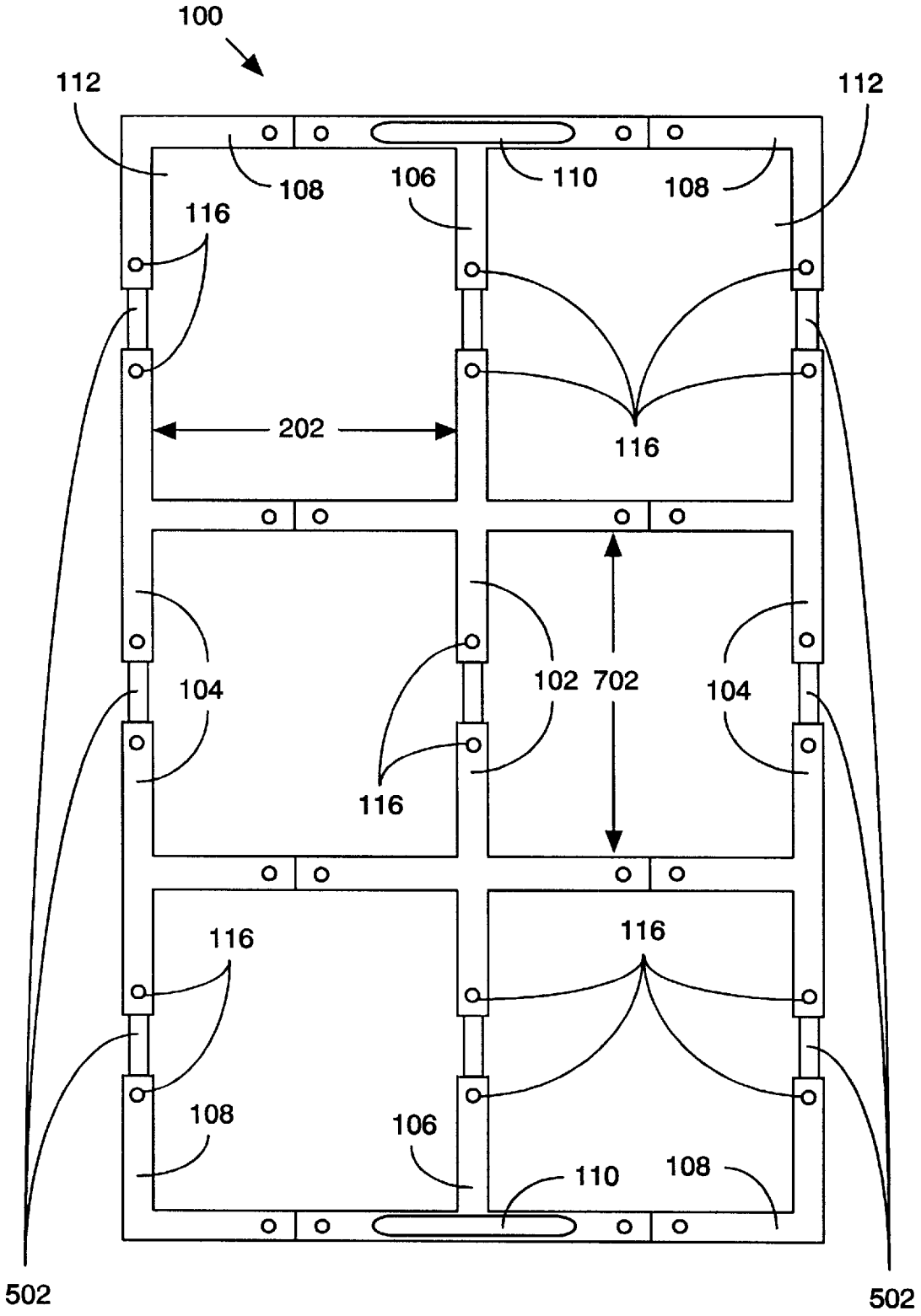
FIG. 7 illustrates a preferred embodiment of the tile alignment tool with the frame segments extended longitudinally.

FIG. 7 illustrates the adjustable tile installation tool 100 in a longitudinally extended position. In this position, the longitudinal size 702 of the tile apertures 112 has been increased by moving the frame segments 106, 108 and 102, 104 to a longitudinally extended position. This is accomplished by loosing retaining knobs 116, sliding the first frame segments 106, 108, first frame segments 102, 104, second frame segments 102, 104, and second frame segments 106, 108, respectively, and then retightening retaining knobs 116. As discussed above in regard to FIG. 6, the adjustment rods 502 allow the size of the tile apertures 112 to be varied by allowing the frame segments 102, 104, 106, 108 to be moved to an extended position.

Figure 8:
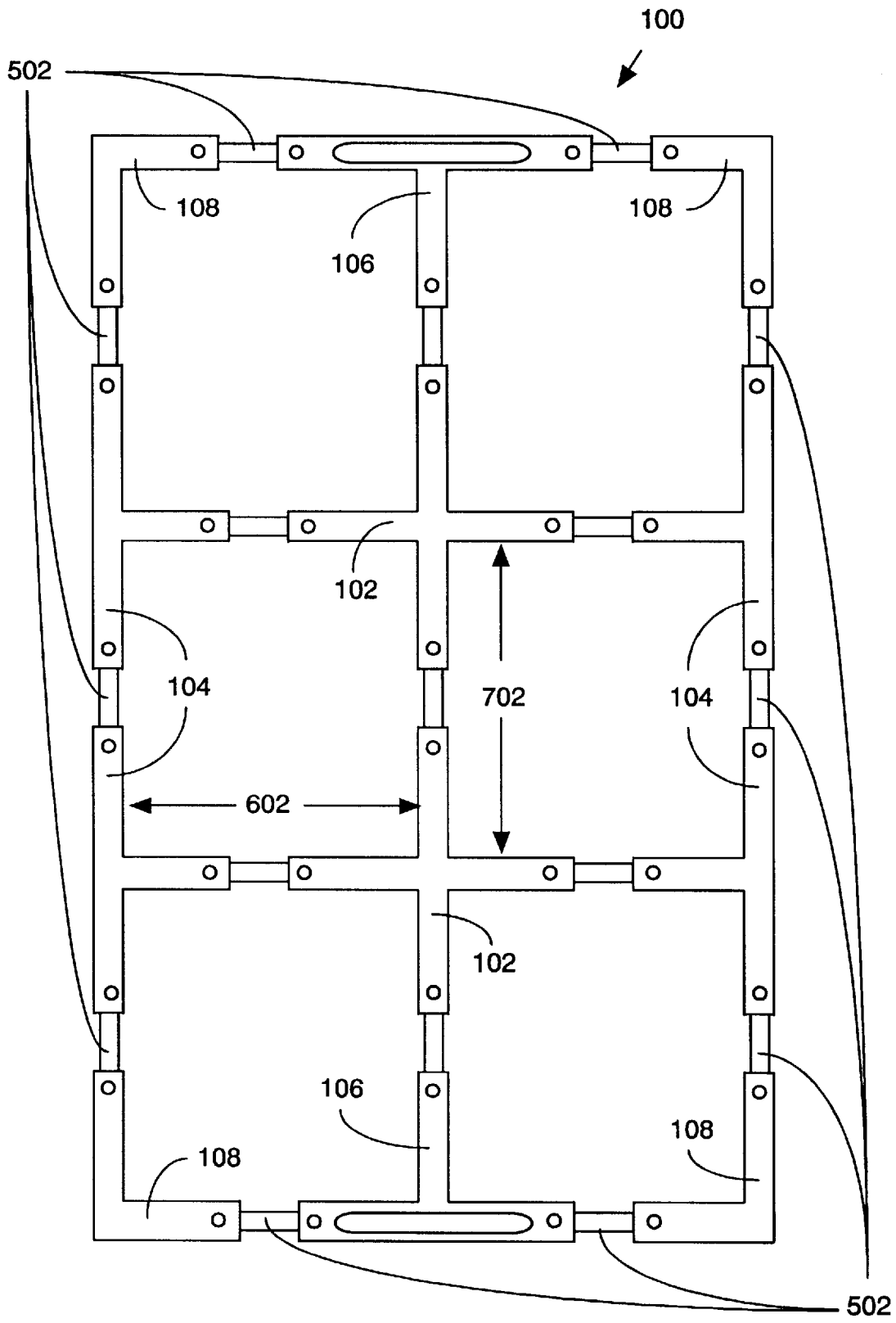
FIG. 8 illustrates a preferred embodiment of the tile alignment tool with the frame segments extended laterally and longitudinally.

FIG. 8 illustrates the adjustable tile installation tool 100 in a laterally and a longitudinally extended position. In this position, the lateral size 602 and the longitudinal size 702 of the tile apertures 112 have been increased. This figure illustrates an important advantage provided by the adjustable tile installation tool 100. In particular, the tile 1002 size which can be installed by the device can be varied laterally, longitudinally, or a combination of both. This provides the tile installer with a single tool that can be used to install tiles 1002 having a variety of shapes and sizes.

Figure 9:
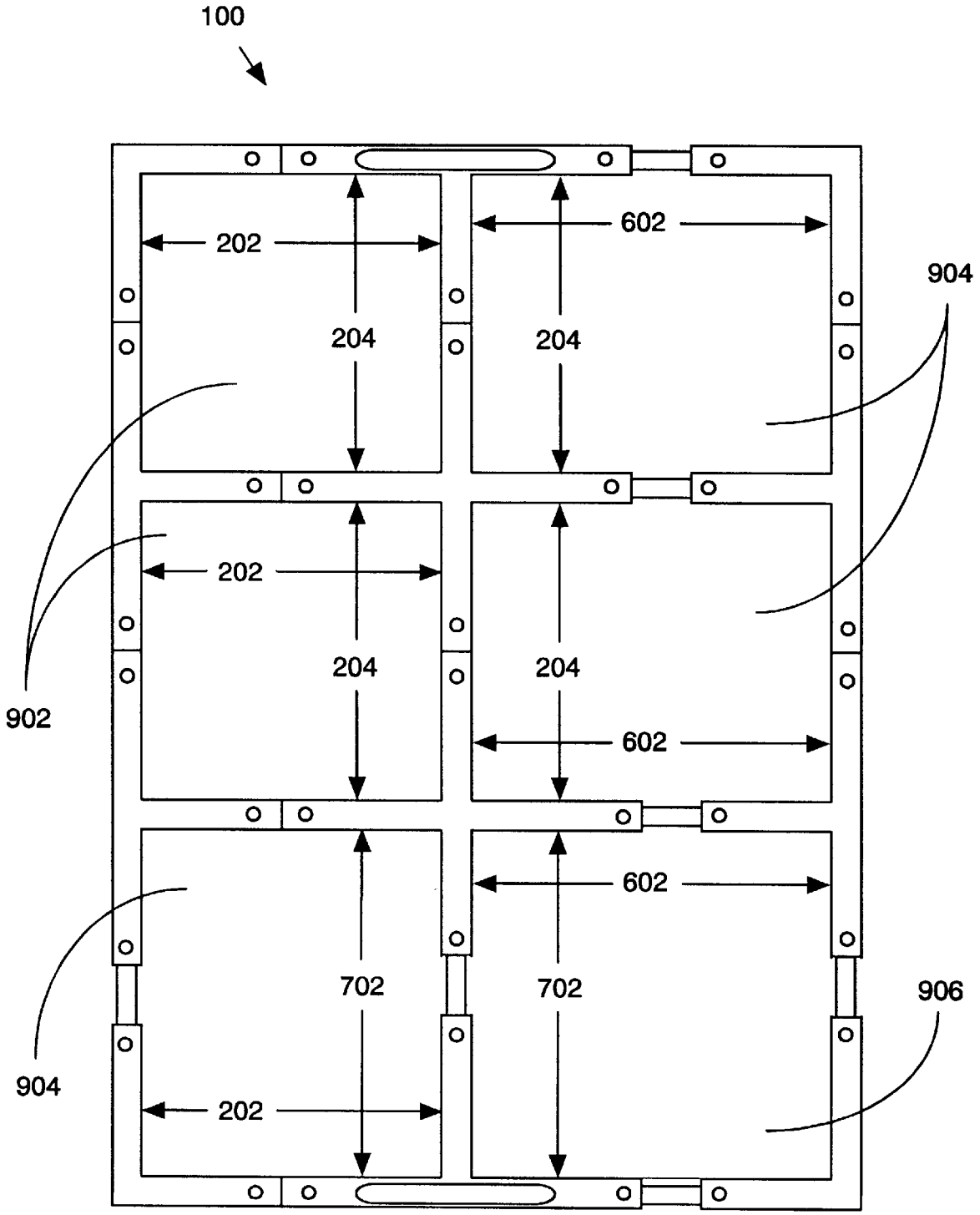
FIG. 9 illustrates a preferred embodiment of the tile alignment tool with some of the frame segments extended laterally, some of the frame segments extended longitudinally and some of the frame segments extended laterally and longitudinally.

FIG. 9 shows the adjustable tile installation tool 100 in a formation which allows multiple tile sizes to be installed at the same time. In this position, two of the tile apertures 112 are in the retracted position, two of the tile apertures 112 are extended laterally, one of the tile apertures 112 is extended longitudinally, and one of the tile apertures 112 is extended laterally and longitudinally. This figure illustrates another important advantage provided by the adjustable tile installation tool 100. In particular, a variety of tile 1002 sizes can be simultaneously installed by the device. This provides the tile installer with a single tool that can be used to install tiles 1002 in patterns. For example, smaller tiles 1002 can be installed in a pattern with an outer edge of larger tiles 1002.

Figure 10A:
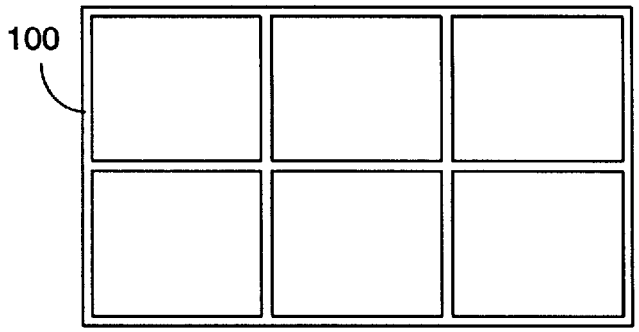
FIGS. 10A–C illustrate a method of using a preferred embodiment of the tile alignment tool to automatically align tiles during installation.
Figure 10B:
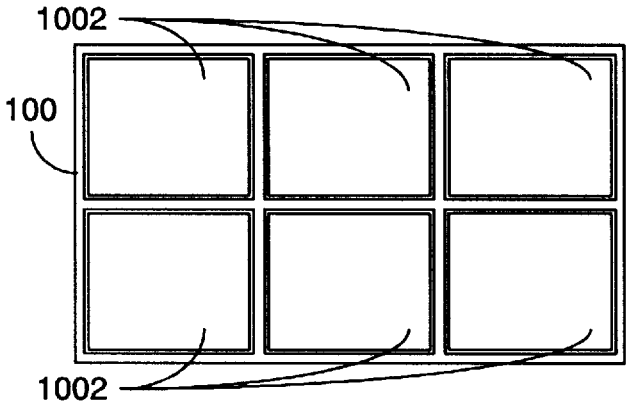
Figure 10C:
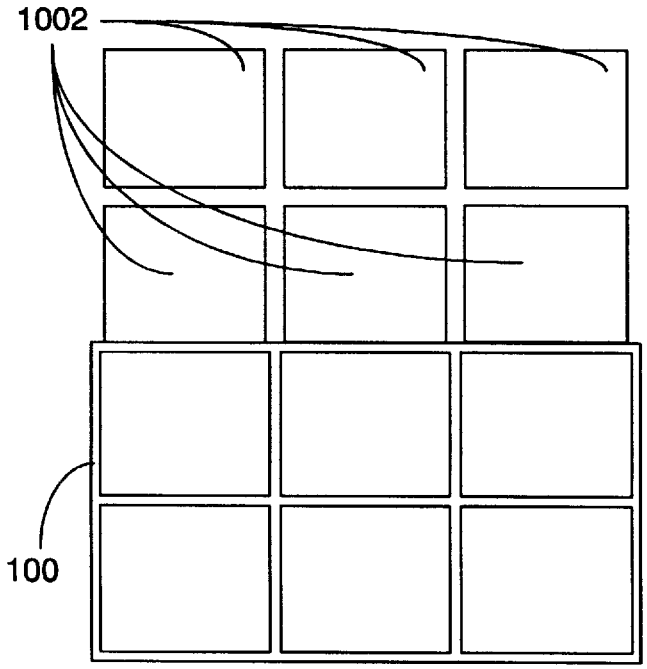

FIGS. 10A–C illustrate the method used to install tiles 1002 with the adjustable tile installation tool 100.

As shown in FIG. 10A, the adjustable tile installation tool 100 is positioned on a target surface. The target surface will have adhesive applied to it prior to positioning of the adjustable tile installation tool 100.

FIG. 10B shows the next step in the installation process. In this step, tiles 1002 are inserted in the tile apertures 112 and are held by the adhesive.

In FIG. 10C, the adjustable tile installation tool 100 is raised up from the target surface. As noted above, seating pins 302 provided easier removal of the device by reducing the contact of the device with the adhesive. The adjustable tile installation tool 100 is then positioned next to the previously installed tiles 1002 and the process is repeated.

Figure 11:
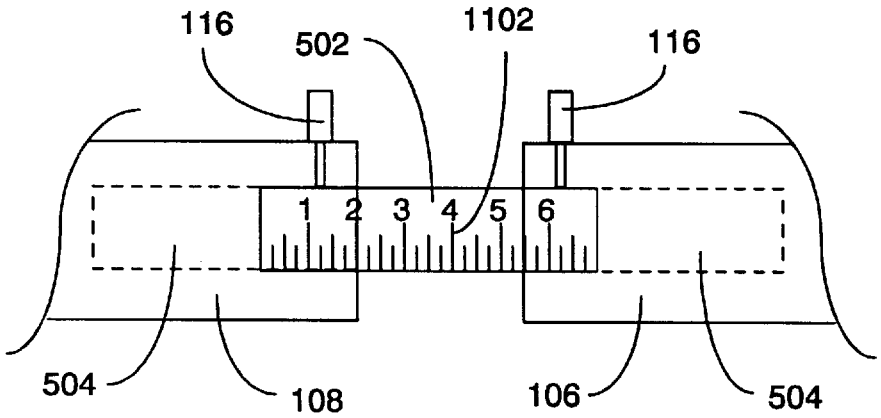
FIG. 11 is an alternative embodiment in which the adjustment rod has indicia which allow the user to set the size of the frame extension.

FIG. 11 is an alternative embodiment in which the adjustment rod 502 has indicia on its side. This allows the increase in size of the tile aperture to be easily measured when a new tile size is used.

While the invention has been described with respect to a preferred embodiment thereof, it will be understood by those skilled in the art that various changes in detail my be made therein without departing from the spirit, scope, and teaching of the invention. For example, the material used to construct the device may be anything suitable for its intended use, the size of the device can vary, the number of tile apertures can vary, etc. Accordingly, the invention herein disclosed is to be limited only as specified in the following claims.

I claim:

1. An adjustable tile installation tool for aligning tiles of varying sizes, comprising:

a frame having a plurality of frame segments, each frame segment forming a portion of a wall;

the frame segments attached to one another such that the wall formed by the frame segments defines a tile aperture having a predetermined size and shape, the frame segments attached to one another by extension means that hold the ends of adjacent frame segments in alignment with one another when the frame segments are attached to one another; and means for securing the ends of adjacent frame segments to the extension means such that the frame segments may extend from or retract to adjacent frame segments such that the size or shape of the tile aperture is increased or decreased;

whereby the tile aperture sizes are adjustable such that they accept tiles of varying sizes.

2. An adjustable tile installation tool for aligning tiles of varying sizes, comprising:

a frame having a plurality of frame segments, each frame segment forming a portion of a wall;

the frame segments attached to one another such that the wall formed by the frame segments defines at least one tile aperture having a predetermined size and shape;

means for selected frame segments to extend from or retract to adjacent frame segments such that the size or shape of the tile aperture is increased or decreased, further comprising:

an adjustment rod channel in the ends of at least two of the frame segments;

at least one adjustment rod, sized to slidably fit within the adjustment rod channels of the two frame segments, such that the ends of the frame segment are in substantial alignment with one another; and means to secure the adjustment rod to the frame segments such that the frame segments are adjustable from a retracted to an extended position;

whereby the tile aperture sizes are adjustable such that they accept tiles of varying sizes.

3. A tool, as in claim 2, wherein the means to secure the adjustment rod to the frame segments are threaded retaining knobs which are threaded through the wall of the frame segment and secure the adjustment rod to the frame segments via pressure engagement.

4. A tool, as in claim 3, further comprising seating pins extending outward from the bottom surface of the frame segments;

whereby the seating pins prevent the bottom surface of the tool from contacting a surface.

5. A tool, as in claim 4, further comprising handle means to raise or lower the tool from a surface.

6. A tool, as in claim 2, wherein:

the frame segments are substantially flat and are sized to the approximate thickness of a grout joint; a the adjustment rod is a flat rod having a suitable thickness for slidable insertion into the adjustment rod channel;

whereby the wall formed by the frame segments spaces the tile apertures such that a predetermined amount of grout space exists between each tile aperture.

7. A tool, as in claim 6, wherein:

the frame segments are arranged such that at least two of the frame segments are substantially laterally adjacent to one another; and the laterally adjacent frame segments can be extended from one another by adjustment of the adjustment rod which attaches them;

whereby the tile apertures are laterally adjustable.

8. A tool, as in claim 6, wherein:

the frame segments are arranged such that at least two of the frame segments are substantially longitudinally adjacent to one another; and the longitudinally adjacent frame segments can be extended from one another by adjustment of the adjustment rod which attaches them;

whereby the tile apertures are longitudinally adjustable.

9. A tool, as in claim 8, wherein:

the frame segments are arranged such that at least two of the frame segments are substantially laterally adjacent to one another; and the laterally adjacent frame segments can be extended from one another by adjustment of the adjustment rod which attaches them;

whereby the tile apertures are laterally adjustable.

10. A tool, as in claim 9, wherein the means to secure the adjustment rod to the frame segments are threaded retaining knobs which are threaded through the wall of the frame segment and secure the adjustment rod to the frame segments via pressure engagement.

11. A tool, as in claim 10, further comprising:

seating pins, the seating pins extending outward from the bottom surface of a sufficient number of the frame segments to prevent the bottom surface of the tool from contacting a surface;

whereby the seating pins prevent the bottom surface of the tool from contacting a surface.

12. A tool, as in claim 11, further comprising handle means to raise or lower the tool from a surface.

13. A tool, as in claim 12, further comprising indicia on the adjustment rod, the indicia visible when the frame segments are extended;

whereby the amount of frame segment extension can be measured by the indicia.

14. A method of installing tiles of varying sizes with a single adjustable tile installation tool, including the steps of:

using a frame having a plurality of frame segments, each frame segment forming a portion of a wall;

shaping the frame segments such that they are substantially flat and are sized to the approximate thickness of a grout joint;

forming an adjustment rod channel in the ends of the frame segments;

slidably inserting an adjustment rod into the adjustment rod channel;

attaching the frame segments to one another at their ends by securing the frame segments to preselected locations on the adjustment rod such that the wall defines at least one tile aperture having a predetermined size and shape;

extending or retracting the frame segments from one another by changing the location on the adjustment rod where the frame segment is attached such that the size or shape of the tile aperture is increased or decreased;

whereby the tile aperture sizes are adjustable to accept tiles of varying sizes and the wall formed by the frame segments spaces the tile apertures such that a predetermined amount of grout space exists between each tile aperture.

15. A method, as in claim 14, including the additional steps of:

arranging the frame segments such that at least two of the frame segments are substantially laterally adjacent to one another; and extending the laterally adjacent frame segments from one another by adjusting the position of the adjustment rod which attaches the frame segments;

whereby the tile apertures are laterally adjustable.

16. A method, as in claim 14, including the additional steps of:

arranging the frame segments such that at least two of the frame segments are substantially longitudinally adjacent to one another; and extending the longitudinally adjacent frame segments from one another by adjusting the position of the adjustment rod which attaches the frame segments;

whereby the tile apertures are longitudinally adjustable.

17. A method, as in claim 16, including the additional steps of:

arranging the frame segments such that at least two of the frame segments are substantially laterally adjacent to one another; and extending the laterally adjacent frame segments from one another by adjusting the position of the adjustment rod which attaches the frame segments;

whereby the tile apertures are laterally adjustable.

18. A method, as in claim 17, including the additional steps of:

threading retaining knobs through the walls of the frame segments to secure the adjustment rod to the frame segments via pressure engagement;

extending seating pins outward from the bottom surface of at a sufficient number of the frame segments to prevent the bottom surface of the tool from contacting a surface;

using a handle to raise or lower the tool from a surface.

19. A method, as in claim 18, including the additional step of using indicia on the adjustment rod to measure the amount of frame segment extension when the frame segments are extended.

* * * * *